US006682285B2

(12) United States Patent
Trovinger et al.

(10) Patent No.: US 6,682,285 B2
(45) Date of Patent: Jan. 27, 2004

(54) SHEET-WISE HOLE PUNCHING AFTER FOLDING IN BOOKLET MAKER

(75) Inventors: Steven W Trovinger, Los Altos, CA (US); Ross R. Allen, Belmont, CA (US)

(73) Assignee: Hewlett-Packard Development Company L.P., Houston, TX (US)

( * ) Notice: Subject to any disclaimer, the term of this patent is extended or adjusted under 35 U.S.C. 154(b) by 77 days.

(21) Appl. No.: 09/820,742

(22) Filed: Mar. 30, 2001

(65) Prior Publication Data

US 2002/0141849 A1 Oct. 3, 2002

(51) Int. Cl.[7] ..... B42C 13/00

(52) U.S. Cl. ..... 412/1; 412/7; 412/9; 412/11; 270/58.12

(58) Field of Search ..... 412/1, 6, 7, 9, 412/11, 12, 13, 14, 16, 18, 33, 38, 39, 40; 493/16, 385, 445, 395; 270/58.12; 271/235

(56) References Cited

U.S. PATENT DOCUMENTS

| | | | | |
|---|---|---|---|---|
| 4,053,150 | A | 10/1977 | Lane | |
| 4,221,373 | A | 9/1980 | Muller Hans | |
| 4,484,501 | A | 11/1984 | Ramcke | |
| 4,575,296 | A | 3/1986 | Kockler et al. | |
| 4,595,187 | A | 6/1986 | Bober | |
| 4,795,071 | A | 1/1989 | Jacobs et al. | |
| 4,891,681 | A | 1/1990 | Fiske et al. | |
| 5,028,193 | A | 7/1991 | Misicka | |
| 5,087,163 | A | 2/1992 | Erdbories et al. | |
| 5,346,350 | A | 9/1994 | Luhman et al. | |
| 5,377,965 | A | 1/1995 | Mandel et al. | |
| 5,452,920 | A | 9/1995 | Parker | |
| 5,465,213 | A | 11/1995 | Ross | |
| 5,632,587 | A | 5/1997 | Coyette | |
| 5,662,318 | A | 9/1997 | Harada et al. | |
| 5,803,891 | A | 9/1998 | Haan et al. | |
| 6,099,225 | A | 8/2000 | Allen et al. | |
| 6,171,225 | B1 * | 1/2001 | Nonoyama et al. | 493/16 |
| 6,193,458 | B1 | 2/2001 | Marsh | |
| 6,363,851 | B1 | 4/2002 | Gerhard et al. | |

FOREIGN PATENT DOCUMENTS

WO WO 0018583 4/2000

OTHER PUBLICATIONS

U.S. patent application No. 09/831,768 filed May 14, 2001, entitled "Method and Apparatus for Making Booklets" by Steven W. Trovinger et al.
U.S. patent application No. 09/934,725 filed Aug. 22, 2001, entitled "Binding System with Sheet–Wise Formation of Features" by Steven W. Trovinger et al.
U.S. patent application No. 10/084,459 filed Feb. 28, 2002, entitled "System for Handling Folded Sheet Material" by Steven W. Trovinger.
U.S. patent application No. 10/084,460 filed Feb. 28, 2002, entitled "Booklet Maker" by Steven W. Trovinger.
U.S. patent application No. 10/231,127 filed Aug. 30, 2002, entitled "Booklet Maker and Method of Manufacturing A Booklet Maker" by Steven W. Trovinger.

* cited by examiner

*Primary Examiner*—Willmon Fridie, Jr.

(57) ABSTRACT

A hole-punching process for a sheet-wise booklet maker, including a hole punching device, a clamp, and a drive system. While a folded booklet sheet is being held stationary on its leading side, the drive system advances the trailing side of the folded sheet, thereby forcing the folded edge of the sheet into a hole punching device. The operation of the drive system is based on sheet information associated with the folded sheet, which includes information such as the order number of the folded sheet within the to-be-assembled booklet and the accumulated thickness of other sheets to be positioned within the folded sheet. Position information is also determined, indicating the instantaneous distance between the folded edge of the sheet with a hole punch in the hole punching device. By comparing provided position information with a correct hole location determined from the sheet information, the drive system advances the folded edge of the sheet to a position within the punching device where the punch creates a hole.

22 Claims, 2 Drawing Sheets

SHEET-WISE HOLE PUNCHING AFTER FOLDING IN BOOKLET MAKER

BACKGROUND OF THE INVENTION

1. Field of the Invention

The present invention generally relates to finishing printed sheets of paper and, more particularly, to hole-punching folded sheets of printed paper.

2. Background Information

A system for finishing printed sheets into booklets is described in U.S. Pat. No. 6,099,225 (Allen et al., hereafter referred to as "the Allen patent"), hereby incorporated by reference in its entirety, where most finishing operations are performed on a sheet-by-sheet basis using precise paper positioning. The system also uses a transverse tool carrier for cutting, scoring, folding, punching, and stapling booklet sheets. The Allen patent does not specifically address the issue of aligning hole locations from one booklet sheet to another when individual sheets are being punched.

Another system for assembling sheets of printing media for booklets is described in PCT No. WO 00/18583 (Trovinger et al., hereafter referred to as "the Trovinger PCT"), hereby incorporated by reference in its entirety. The Trovinger PCT includes an operation where either a single booklet sheet or a collected stack of booklet sheets is punched (or drilled) to form holes, e.g., to allow storage in a three-ring binder. In the Trovinger PCT, individual printed sheets undergo a punching operation prior to a folding operation. If a completed booklet is to be placed in, for example, a three-ring binder, six holes would need to be created in each flat, pre-folded booklet sheet (i.e., three holes per each side or "page"), an operation requiring six punch actions. Also, the Trovinger PCT does not specifically account for the alignment of hole locations from one booklet sheet to another when individual sheets are being punched. In the alternative hole-punching operation, where booklet sheets are to be punched together as a collected stack, relatively high forces are needed to force sheet materials through multiple pages of a booklet.

Accordingly, what is needed is a low-cost and efficient process for hole-punching booklet sheets, requiring less and lower-force punch actions, and providing sheet-to-sheet hole alignment.

SUMMARY OF THE INVENTION

The present invention is directed to hole-punching folded booklet sheets in a sheet-wise booklet making system, where sheet information associated with each booklet sheet is used to determine the locations on the booklet sheet where holes are to be created.

According to a first embodiment of the present invention, a method of forming booklets is provided, comprising the steps of folding sheets, punching the folded sheets individually at hole punch locations determined based on sheet information, stacking the punched sheets, and binding the stacked sheets in a booklet.

According to a second embodiment of the present invention, a hole-punching apparatus is provided, comprising a clamping device, a drive system, wherein a folded sheet is held stationary by the clamping device on a first side and is driven by the drive system on a second side, and a punch tool having a hole punch, wherein a folded edge of the folded sheet is positioned relative to the hole punch based on the driving of the second side of the folded sheet.

According to a third embodiment of the present invention, a method of hole-punching booklet sheets is provided, comprising the steps of holding stationary a leading side of a folded sheet, driving a trailing side of the folded sheet such that a folded edge of the folded sheet is moved into a punching device, wherein the trailing side is driven based on position information and sheet information, and punching at least one hole in the folded sheet with the punching device.

According to a fourth embodiment of the present invention, an apparatus for hole-punching booklet sheets is provided, comprising means for punching a hole in a folded sheet, means for holding stationary a leading side of the folded sheet, and means for driving a trailing side of the folded sheet such that a folded edge of the folded sheet is moved into the means for punching, wherein the trailing side is driven based on position information and sheet information.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1:
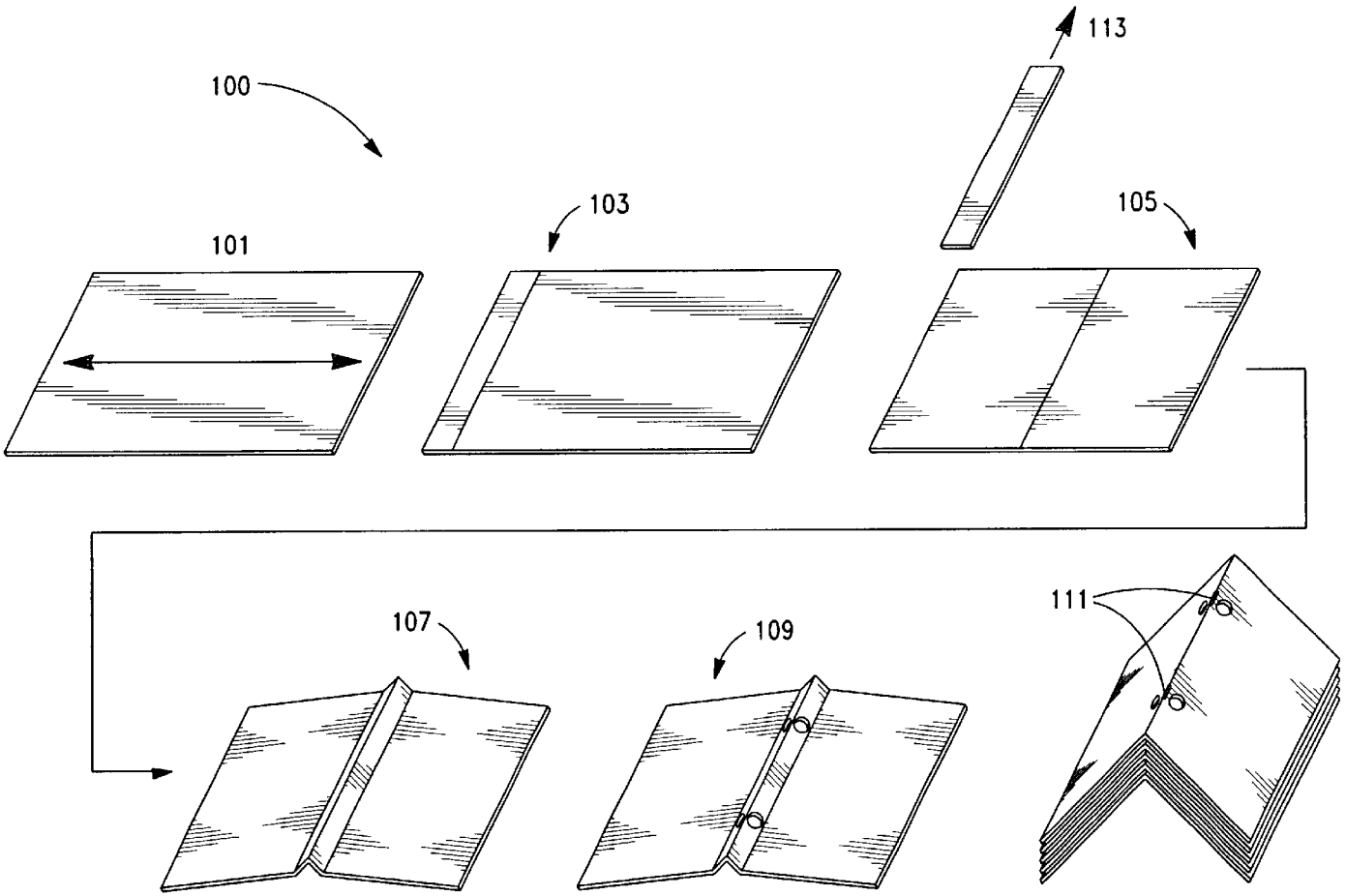
FIG. 1 illustrates a process flow in accordance with an embodiment of the present invention.

FIG. 1 illustrates a process flow according to an embodiment of the present invention. The process flow 100 breaks the paradigm for traditional, non-sheetwise booklet-making and begins with the feeding and alignment 101 of a printed sheet. The operations of trimming 103, scoring 105, folding 107, and hole-creation 109 (e.g., by punching or drilling) are performed on each sheet individually. Operation 109 shows the creation of two holes near the folded edge of a sheet, but of course the number of holes created is not limited by this example. Although trimming to length is shown in the diagram, trimming to width can also be done. In either event, the trimmed portions are ejected for disposal 113. In operation 111, the folded and punched sheets are assembled by stacking and are bound (e.g., by stapling) into a booklet form.

To produce booklets having perfect sheet-to-sheet hole alignment in a sheet-wise process, the step of hole-punching 109 must take into account information relating to each individual folded sheet. In other words, the distance between each punched hole and the folded edge of a sheet is a very important consideration in sheet-wise booklet processing. For example, if holes were punched in the same locations on folded sheets on a sheet-by-sheet basis, at the same distances from each folded edge, the resultant booklet would have holes out-of-alignment from one sheet to another. Such a booklet may not be easily inserted into a ring binder.

Therefore, to achieve sheet-to-sheet hole alignment in an assembled booklet, the distances between the folded edges and hole locations of each folded booklet must be different.

This is necessitated by the effect of outer booklet sheets wrapped over inner booklet sheets. That is, hole locations for a folded booklet sheet depend upon the sheet's position within a completed booklet and upon the accumulated thickness of other booklet sheets positioned between the sides of the folded booklet sheet. As a result, for example, the distance between the folded edge and hole locations of the outermost folded sheet (e.g., the booklet cover) must be greater than the distances between the folded edges and hole locations of all of the folded sheets stacked within the outermost folded sheet. The innermost folded sheet will necessarily have the least distance relative to the other sheets between its folded edge and hole locations.

Figure 2:
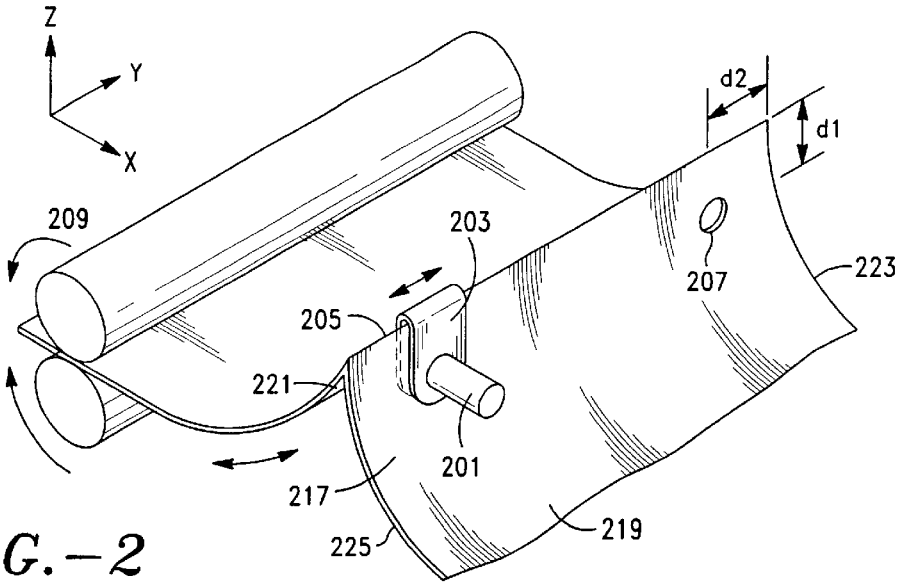
FIG. 2 is a perspective view of a hole punching apparatus in accordance with an embodiment of the present invention.

FIG. 2 illustrates a first view of a hole-punching apparatus in a sheet-wise system that allows the precision needed by the above-described process. After undergoing a folding operation 107, a single folded booklet sheet 217 is positioned to have holes created in it (e.g., by punching). The existence of a folded edge 205 creates two sides of folded sheet 217 on either side of folded edge 205: a leading edge 219 and a trailing edge 221. In the FIG. 2 example, a means for punching a hole in a folded sheet is represented by a punch tool 203, a punching device that includes a hole punch 201. A means for driving the trailing side 211 is represented by drive system 209.

Punch 201 operates to create a hole (such as hole 207) in folded sheet 217, and is attached to and carried by punch tool 203 along the y-axis, which is also the axis on which folded edge 205 is oriented. The y-axis can be oriented in any direction, for example, parallel or perpendicular to the ground. Punch 201 can be of conventional or any other construction. Punch 201 travels on a slider support 415 (FIG. 4), which is held by a carriage, and can be driven by a belt drive or any other means. Punch 201 is shown to be positioned over leading side 219, but can alternatively be positioned over trailing side 221.

Because the creation of each hole involves forcibly removing sheet material from only two sheet layers at a time (i.e., leading side 219 and trailing side 221), punch 201 operates at a force considerably less than the forces required to operate punching devices used in traditional booklet-making systems. Because of this, costs associated with operation 109 are lower than for other booklet-making systems in regards to operation and tool replacement. Also, because sheet 317 is folded by an upstream folding apparatus before entering the hole-punching apparatus, the amount of punch actions required to create the holes is only half the amount necessary in pre-folding punch operations. Using the earlier example, the creation of six binder holes using the present invention would only require three punch actions, as opposed to six.

Hole 207 is shown to be located at a distance d1 from folded edge 205 in the z-axis and a distance d2 from edge 223 in the y-axis. For all of the folded sheets that undergo the hole-punching process, the distance d2 (as well as all distances between any other hole and edge 223 in the y-axis) is maintained constant from one sheet to another. This is because the effect of wrapping outer sheets around inner sheets does not alter the locating of hole 207 or its corresponding holes on the other folded sheets along the y-axis.

However, each folded sheet may enter the hole-punching apparatus at a position slightly different from a preceding or succeeding folded sheet. In other words, the positions of top/bottom edges 223 and 225 may differ from one folded sheet to another along the y-axis relative to the hole-punching apparatus. To adjust for these "floating" edge positions, and to allow punch tool 203 to be accurately positionable, a sensor 413 (shown in FIG. 4) can be used to detect the positions of edge 223 and/or edge 225 (represented in FIG. 4 as edges 423 and 425) for each folded sheet entering the hole-punching apparatus. In this way, the apparatus can be recalibrated for each folded sheet, and each hole-locating distance along the y-axis (e.g., distance d2) can be precisely determined based on the detected edge positions, thus allowing accurate positioning of punch tool 203. Sensor 413 can be used to detect the top/bottom edge positions along the y-axis, as well as the position of a folded sheet edge along the z-axis, as described below. Alternatively, a separate, secondary sensor 427 (shown in FIG. 4 in dotted lines) can be dedicated to the detection of top/bottom edge positions 423 and/or 425.

Figure 3:
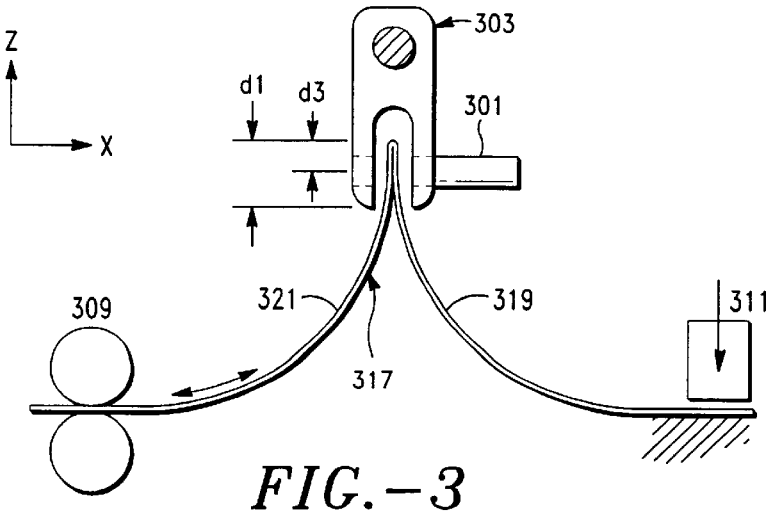
FIG. 3 is an end view of the hole punching apparatus of FIG. 1.

The distance d1 (i.e., the distance from the folded edge of a folded sheet to each hole) is different for each folded sheet and must be adjusted accordingly. In FIG. 3, which illustrates another view of the hole-punching process, a means for holding stationary a leading side 319 of folded sheet 317 is represented by clamp 311. Clamp 311 can be a device dedicated for the sole purpose of holding sheet material stationary, or can be another device in a booklet-making system, such as a secondary drive system. The movement of trailing side 321 is controlled by drive system 309. When leading side 319 is being held stationary and drive system 309 advances trailing side 321 in the +x direction, folded edge 305 is forced in the +z direction. Punch 301 and punch tool 303 are fixed with respect to drive system 309 and clamp 311 in the z-axis, and the operation of drive system 309 serves to change a relative and instantaneous distance d3 between folded edge 305 and punch 301.

Figure 4:
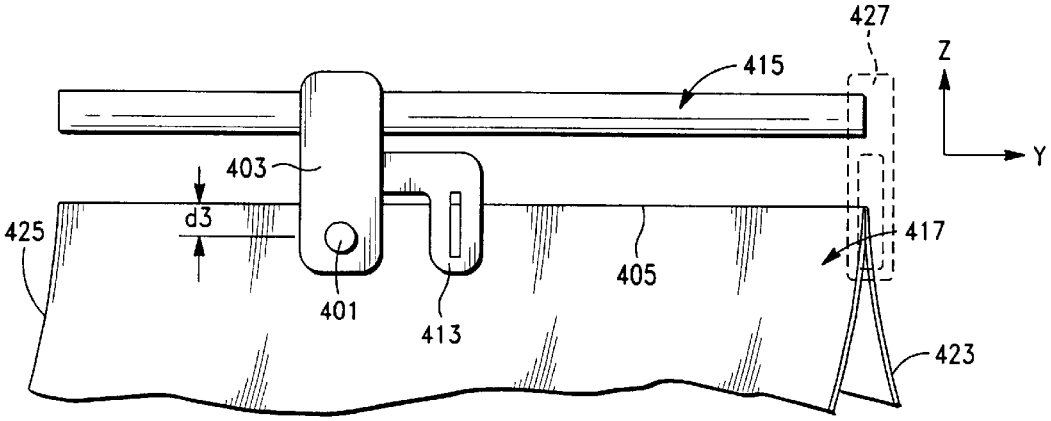
FIG. 4 is a side view of the hole punching apparatus of FIG. 1.

Drive system 309 advances trailing side 321 (thereby changing distance d3) based on sheet information and position information provided to drive system 309 regarding folded sheet 317. Sheet information can include the order number of folded sheet 317, that is, the position of folded sheet 317 within the completed booklet. Sheet information can also include the thickness of folded sheet 317 and the accumulated thickness of other booklet sheets to be positioned between the two sides 319 and 321 of folded sheet 417. Of course, the information included in the sheet information is not limited to these examples. Thus, a correct distance d1 for a particular folded sheet 317 can be determined based on the sheet information associated with that sheet. Position information relates to the instantaneous distance d3 between punch 301 and folded edge 305. In FIG. 4, sensor 413 operates to precisely determine position information, that is, the instantaneous distance d3 between folded edge 405 of folded sheet 417 and punch 401.

During operation of hole-punching step 109, distance d3 is compared to the correct distance dl for folded sheet 317 while drive system 309 advances folded sheet 317 until the two values are found to be equal. At this instant, drive system 309 ceases to operate, and punch 301 creates a hole in folded sheet 317. If other holes need to be created on the same folded sheet 317, drive system 309 remains stopped, and punch tool 303 travels along the y-axis to predetermined points where punch 301 creates the other holes. Alternatively, multiple fixed or movable punch tools similar to punch tool 303 can be provided.

Folded sheets can therefore be accurately positioned in one axis (e.g., z-axis) under the control of drive system 209, 309, and punch tool 203 can be precisely positioned relative to the folded sheets in a second axis (e.g., y-axis). In this way, the present invention provides for the accurate hole-punching of booklet sheets in a sheet-wise booklet making system, while also ensuring sheet-to-sheet hole alignment.

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A method of forming booklets, comprising the steps of:

folding sheets;

punching the folded sheets individually at hole punch locations relative to a sensed position of a folded edge of the individual folded sheet, the hole punch locations being determined based on sheet information;

stacking the punched sheets; and binding the stacked sheets in a booklet, wherein the sheet information includes an order number of each sheet and the hole punch location of each folded sheet varies based on the order number of the folded sheet in the booklet.

2. The method of claim 1, wherein the step of punching comprises the step of positioning a folded edge of each folded sheet within a punching device based on sheet information.

3. The method of claim 2, wherein the step of positioning comprises for each folded sheet the step of holding stationary a leading side of the folded sheet while driving a trailing side of the folded sheet such that the folded edge of the folded sheet is moved within the punching device.

4. A hole-punching apparatus, comprising:

a clamping device;

a drive system, wherein a folded sheet is held stationary by the clamping device on a first side and is driven by the drive system on a second side;

a punch tool having a hole punch, wherein a folded edge of the folded sheet is positioned relative to the hole punch by the driving of the second side of the folded sheet; and a sensor for determining a position of the folded edge relative to the hole punch and for providing position information based on the determined position, wherein a location of a hole punched in the folded sheet varies based on an order number of the folded sheet in a booklet.

5. The apparatus of claim 4, wherein the second side of the folded sheet is driven based on the position information and on a sheet information.

6. The apparatus of claim 5, wherein the sheet information comprises the order number of the folded sheet in the booklet.

7. A method of hole-punching booklet sheets, comprising the steps of:

holding stationary a leading side of a folded sheet;

driving a trailing side of the folded sheet such that a folded edge of the folded sheet is moved into a punching device, wherein the trailing side is driven based on position information and sheet information; and punching at least one hole in the folded sheet with the punching device, wherein a location of the at least one hole in the folded sheet varies based on an order number of the folded sheet in a booklet.

8. The method of claim 7, wherein a position of the folded edge relative to a hole punch of the punching device is based on the driving of the trailing side.

9. The method of claim 7, wherein the position information comprises information relating to the position of the folded edge relative to a hole punch of the punching device.

10. An apparatus for hole-punching booklet sheets, comprising:

means for punching a hole in a folded sheet;

means for holding stationary a leading side of the folded sheet; and means for driving a trailing side of the folded sheet such that a folded edge of the folded sheet is moved into the means for punching, wherein the trailing side is driven based on position information and sheet information, the sheet information including an order number of each sheet and the hole punch location of each folded sheet varies based on the order number of the folded sheet in the booklet.

11. The method of claim 10, wherein the position information comprises information relating to the position of the folded edge relative to a hole punch of a punching device.

12. The apparatus of claim 4, wherein the sensor determines positions of at least one of a top edge and a bottom edge of the folded sheet.

13. The apparatus of claim 4, wherein a secondary sensor determines positions of at least one of a top edge and a bottom edge of the folded sheet.

14. The method of claim 1, wherein the sheet information comprises information on an accumulated thickness of booklet sheets to be positioned between two sides of each folded sheet.

15. The apparatus of claim 5, wherein the sheet information comprises an accumulated thickness of other booklet sheets to be positioned between the first and second sides of the folded sheet.

16. The method of claim 7, wherein the sheet information comprises information on an accumulated thickness of other booklet sheets to be positioned between the leading and trailing sides of the folded sheet.

17. The method of claim 10, wherein the sheet information comprises information on an accumulated thickness of other booklet sheets to be positioned between the leading and trailing sides of the folded sheet.

18. The method of claim 1, wherein the hole punch location measured from a folded edge increases as the order number of the folded sheet increases from an innermost folded sheet to an outermost folded sheet.

19. The apparatus of claim 7, wherein the location of the at least one hole measured from a folded edge increases as the order number of the folded sheet increases from an innermost folded sheet to an outermost folded sheet.

20. The apparatus of claim 10, wherein the location of the hole measured from a folded edge increases as the order number of the folded sheet increases from an innermost folded sheet to an outermost folded sheet.

21. The apparatus of claim 4, wherein the hole punch location measured from a folded edge increases as the order number of the folded sheet increases from an innermost folded sheet to an outermost folded sheet.

22. The method of claim 2, wherein the sensed position of the edge of the individual folded sheet is a position within the punching device between the folded edge and a punch of the punching device.

* * * * *